US008133059B1

(12) United States Patent
Hsiao

(10) Patent No.: US 8,133,059 B1
(45) Date of Patent: Mar. 13, 2012

(54) ANGLE-ADJUSTABLE NIGHT LAMP ASSEMBLY FOR AROMA DIFFUSING NIGHT LAMP SYSTEM

(76) Inventor: Ming Jen Hsiao, Toufen (TW)

( * ) Notice: Subject to any disclaimer, the term of this patent is extended or adjusted under 35 U.S.C. 154(b) by 0 days.

(21) Appl. No.: 12/911,939

(22) Filed: Oct. 26, 2010

(51) Int. Cl.
*H01R 39/00* (2006.01)

(52) U.S. Cl. ..... 439/11; 439/540.1; 362/287

(58) Field of Classification Search ..... 439/11, 439/13, 233–238, 339, 540.1, 541, 699.2; 362/253, 287
See application file for complete search history.

(56) References Cited

U.S. PATENT DOCUMENTS 4,382,647 A * 5/1983 Paley ..... 439/10
6,843,656 B2 * 1/2005 Hwang et al. ..... 439/11
7,473,007 B1 * 1/2009 Wang ..... 362/187
7,744,259 B2 * 6/2010 Walczak et al. ..... 362/421
2007/0258242 A1 * 11/2007 Lin ..... 362/250

* cited by examiner

*Primary Examiner* — Khiem Nguyen
(74) *Attorney, Agent, or Firm* — Ming Chow; Sinorica, LLC

(57) ABSTRACT

An angle-adjustable night lamp assembly includes an electrical plug unit, which includes housing having a stepped rear coupling portion and an electrically insulative locating block tightly fitted into a front opening of the electrically insulative plug housing to hold first and second metal conducting blades and a grounding prong, a lamp socket unit for holding a low-voltage lamp bulb and transferring electric current from the electrical plug unit to the low-voltage lamp bulb for causing the low-voltage lamp bulb to emit light, and a collar configured subject to the configuration of the stepped rear coupling portion of the electrically insulative plug housing and coupled to the stepped rear coupling portion and affixed to the lamp socket unit to secure the lamp socket unit to the electrical plug unit and to allow adjustment of the angle of the lamp socket unit relative to the electrical plug unit.

6 Claims, 8 Drawing Sheets

ANGLE-ADJUSTABLE NIGHT LAMP ASSEMBLY FOR AROMA DIFFUSING NIGHT LAMP SYSTEM

BACKGROUND OF THE INVENTION

1. Field of the Invention

This invention relates aroma diffusing night lamp system and more particularly, to an angle-adjustable night lamp assembly for aroma diffusing night lamp system that allows adjustment of the angular position of the electrical plug unit relative to the socket unit.

2. Description of the Related Art

Conventional night lamp does not allow adjustment of the angular position of the two parallel metal prongs of their electric plugs to fit different indoor installation requirements.

There are night lamps with an added aroma diffusing function. These night lamps combine an angle-adjustable night lamp unit and an aroma diffuser unit. When the night lamp unit of a night lamp is connected to a city power supply outlet, the radiating heat from the night lamp unit heats an aromatic substance, for example, essential oil in the aroma diffuser unit into vapor, providing a romantic atmosphere and enhancing the value of use of the night lamp.

Although conventional aroma diffusing night lamps allow adjustment of the installation angle of the night lamp unit, their angle-adjustable structure wears quickly with use or is difficult to be adjusted to the accurate angle. After installation, the applied essential oil may fall from the lampshade accidentally.

Further, regular aroma diffusing night lamps commonly use an incandescent lamp bulb to emit light and to heat the supplied aromatic substance. The heating efficiency of an incandescent lamp is low. Further, the aroma diffuser unit of a regular aroma diffusing night lamp is less stable. In consequence, a gap may be produced in the electric conducting structure, affecting the performance of electric conductivity. Further, regular aroma diffusing night lamps have no means to seal the electric conducting component parts. If the aromatic fluid leaks out, a short circuit accident may occur.

Further, U.S. Pat. No. 7,744,259 discloses a directionally-adjustable LED spotlight that is comprised of a fixed heat sink and an LED-array-bearing structure, wherein LED-array-bearing structure is adjustably attached in a heat transfer relationship to the fixed heat sink.

U.S. Pat. No. 7,473,007 discloses an adjustable lamp, which includes a lamp and a scattering shade which is slidable on the lamp. The scattering shade has a front end coupled with a reflective blade which is bent at a selected angle to reflect light. By sliding the scattering shade on a light penetrative shade, the position of the reflective blade can be changed to alter the reflective direction of the light.

United States Patent Application 20070258242 discloses a lamp that includes at least one decorative bar, and at least one socket angle adjustably mounted on the decorative bar. Thus, the socket is angle adjustable relative to the decorative bar to adjust the angle of the electric bulb on the socket so as to satisfy a user's requirement.

SUMMARY OF THE INVENTION

The present invention has been accomplished under the circumstances in view. It is therefore the main object of the present invention to provide an angle-adjustable night lamp assembly, which allows easy adjustment of the angular position of the electrical plug unit relative to the socket unit. It is another object of the present invention to provide an angle-adjustable night lamp assembly, which is practical for use in an aroma diffusing night lamp system. It is still another object of the present invention to provide an angle-adjustable night lamp assembly, which produces a clicking sound upon adjustment of the angle of the socket unit relative to the electrical plug unit step by step.

To achieve these and other objects of the present invention, an angle-adjustable night lamp assembly comprises an electrical plug unit, a lamp socket unit and a collar. The electrical plug unit is adapted for connection to an electrical outlet for power input, comprising an electrically insulative plug housing having a stepped rear coupling portion and a front opening, an electrically insulative locating block tightly fitted into the front opening of the electrically insulative plug housing and having two mounting through holes, and a first metal conducting blade and a second metal conducting blade respectively fastened to the two mounting through holes of the electrically insulative locating block for insertion into the neutral slot and hot slot of an electrical outlet for power input. The lamp socket unit is adapted for holding a low-voltage lamp bulb and transferring electric current from the electrical plug unit to the low-voltage lamp bulb for causing the low-voltage lamp bulb to emit light. The collar is configured subject to the configuration of the stepped rear coupling portion of the electrically insulative plug housing of the electrical plug unit and coupled to the stepped rear coupling portion and affixed to the lamp socket unit to secure the lamp socket unit to the electrical plug unit and to allow adjustment of the angle of the lamp socket unit relative to the electrical plug unit.

Further, the electrical plug unit comprises a grounding prong fixedly mounted in the electrically insulative locating block in a parallel manner relative to the first metal conducting blade and the second metal conducting blade for grounding.

Further, the lamp socket unit comprises: an electrically insulative socket housing comprising an angled support member fixedly mounted fastened to the collar, and a socket member mounted on the angled support member; a positive copper plate and a negative copper plate fixedly mounted in the angled support member for the contact of the ring contact and tip contact of a lamp bulb being mounted in the socket member; a ring contact kept in contact with the first metal conducting blade of the electrical plug unit and electrically connected to one of the positive copper plate and a negative copper plate, the ring contact comprising a ring head and a mounting strip perpendicularly extended from the periphery of the ring head and inserted into one transverse groove in the first half shell such that the ring contact is prohibited from rotation relative to the first half shell and movable linearly in direction relative to the axis of the electrical plug unit; a plurality of first spring members mounted in one end of the first half shell and stopped against the ring head of the ring contact to impart an outward pressure to the ring head toward the electrical plug unit and to force the ring head in positive contact with the first metal conducting blade of sad electrical plug unit; a center contact kept in contact with the second metal conducting blade of the electrical plug unit and electrically connected to the other of the positive copper plate and a negative copper plate, the center contact comprising a contact head and a mounting strip perpendicularly extended from the periphery of the contact head and inserted into one transverse groove in the first half shell such that the center contact is prohibited from rotation relative to the first half shell and movable linearly in direction relative to the axis of the electrical plug unit; and a second spring member mounted in one end of the first half shell and stopped against the contact head of the center contact to impart an outward pressure to the contact head toward the electrical plug unit and to force the contact head in positive contact with the second metal conducting blade of sad electrical plug unit.

The angle-adjustable night lamp assembly further comprises a third sprig member mounted in the second half shell of the angled support member, and a power switch mounted on the second half shell of the angled support member and supported on the third spring member and operable to switch on/off the connection between the ring contact and center contact and the positive copper plate and the negative copper plates.

Further, the ring head comprises a plurality of recessed portions and raised portions alternatively and equiangularly arranged on an outer side thereof for the contact of first metal conducting blade of the electrical plug unit.

Further, the angled support member is formed of a first half shell and a second half shell, having a track extending around the periphery of one end thereof; the socket member is coupled to the track of the angled support member and rotatable relative to the angled support member.

DETAILED DESCRIPTION OF THE PREFERRED EMBODIMENT

Figure 1:
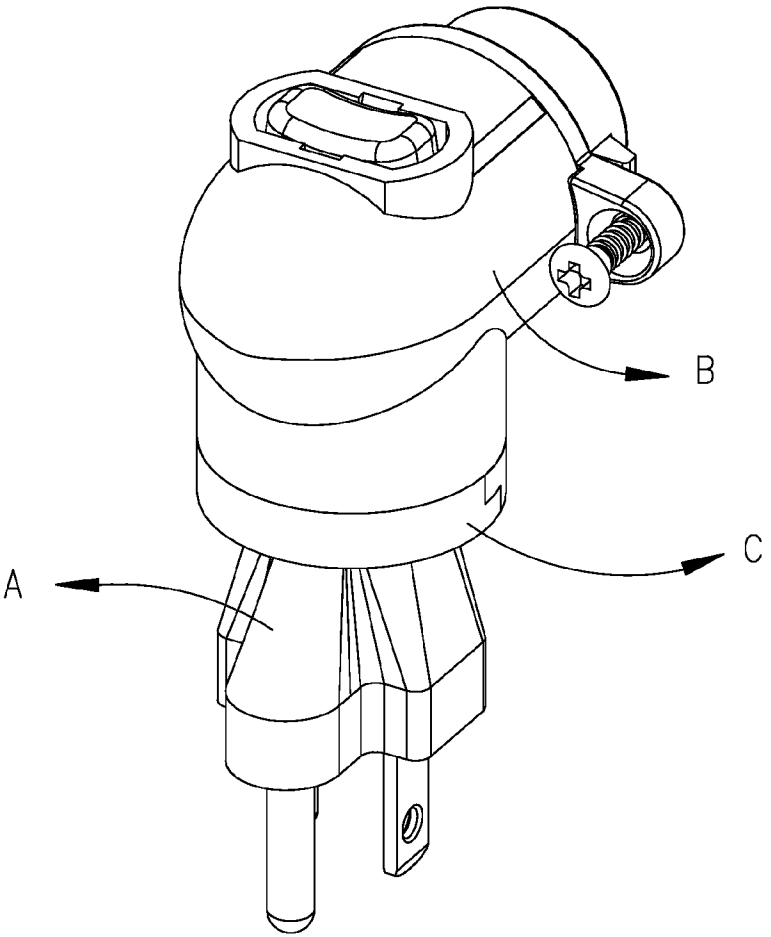
FIG. 1 is an elevational view of an angle-adjustable night lamp assembly in accordance with the present invention.
Figure 2:
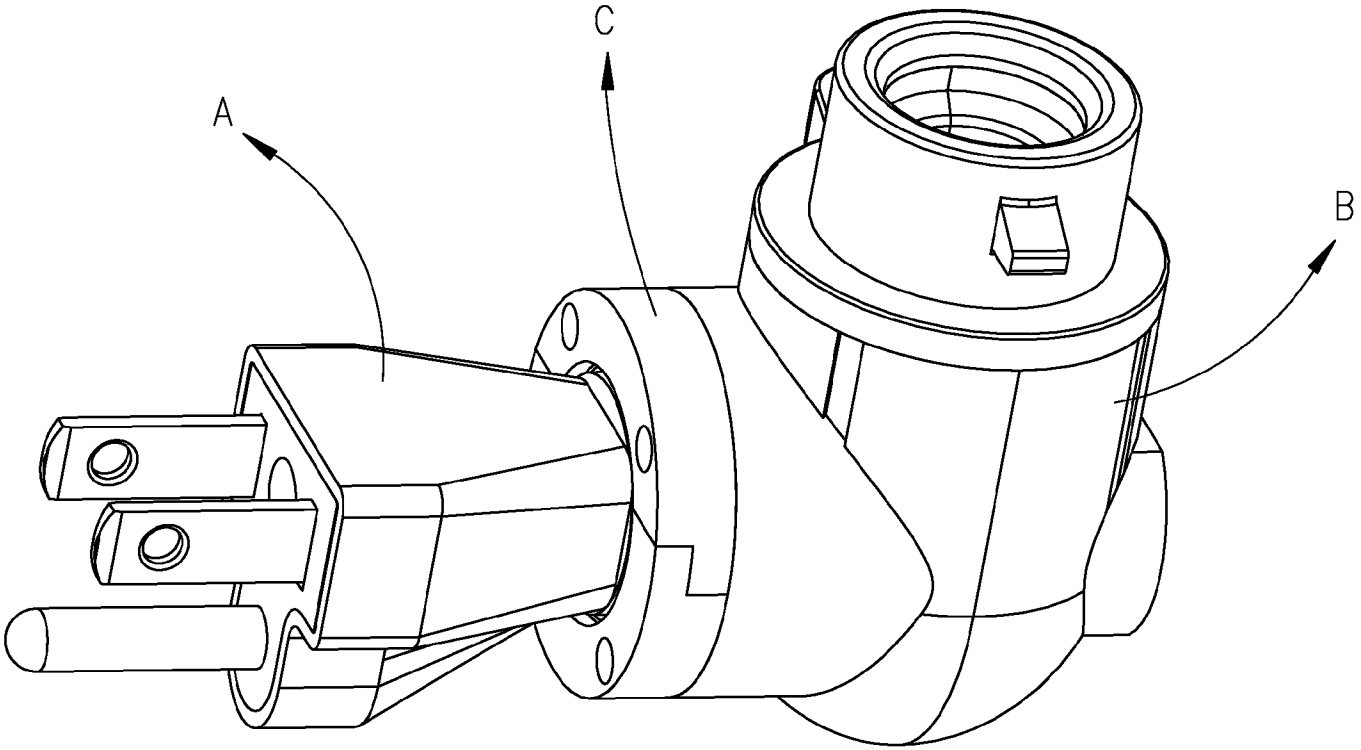
FIG. 2 is another elevational view of the angle-adjustable night lamp assembly in accordance with the present invention.

Referring to FIGS. 1 and 2, an angle-adjustable night lamp assembly for aroma-diffusing night lamp system in accordance with the present invention is shown comprising an electrical plug unit A for connection to an electrical outlet for power input, a lamp socket unit B for holding a low-voltage lamp bulb (not shown) and transferring electric current from the electrical plug unit A to the low-voltage lamp bulb for causing the low-voltage lamp bulb to emit light, and a collar C, which is coupled to one end of the electrical plug unit A and affixed to the lamp socket unit B to secure the lamp socket unit B to the electrical plug unit A, allowing adjustment of the angle of the lamp socket unit B relative to the electrical plug unit A.

Figure 3:
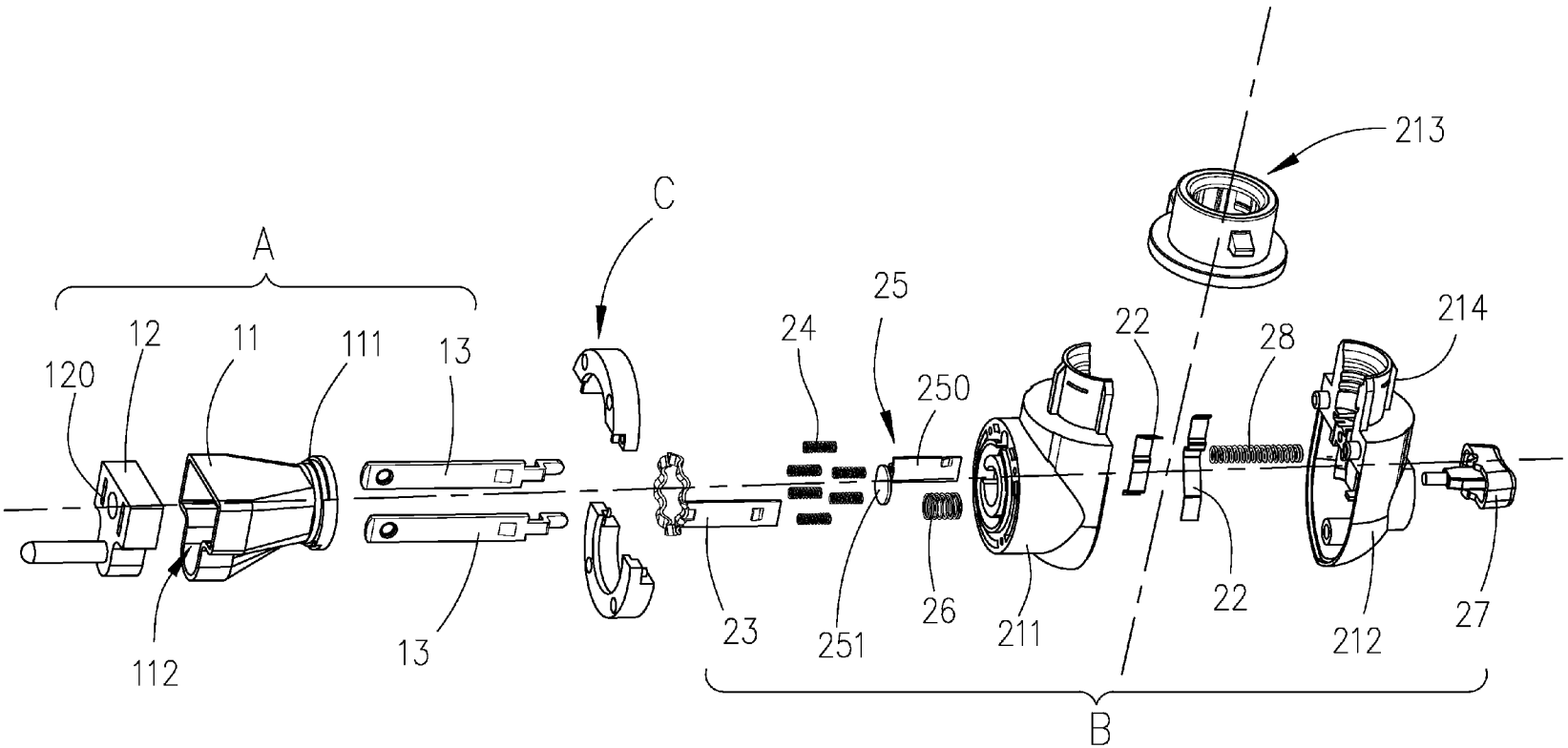
FIG. 3 is an exploded view of the angle-adjustable night lamp assembly in accordance with the present invention.
Figure 4B:
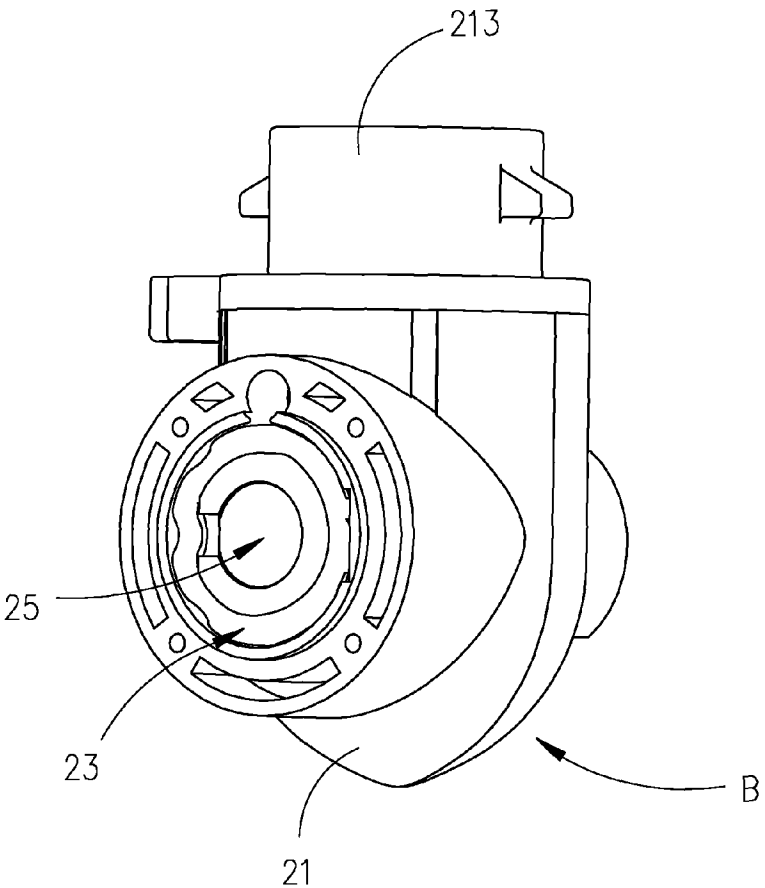
FIG. 4B is an elevational view of the lamp socket unit of the angle-adjustable night lamp assembly in accordance with the present invention.
Figure 4A:
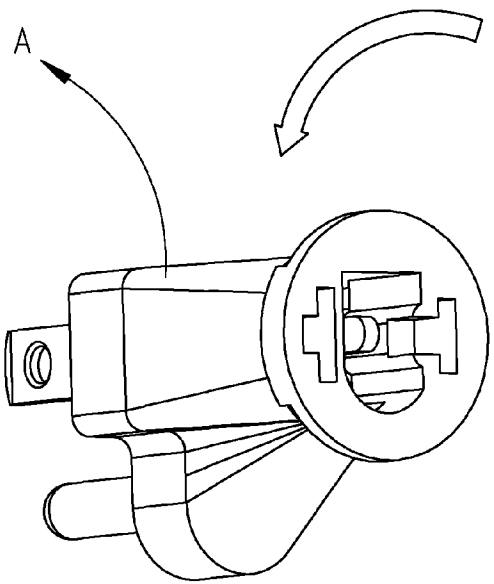
FIG. 4A is an elevational view of the electrical plug unit of the angle-adjustable night lamp assembly in accordance with the present invention.

Referring to FIG. 3 and FIG. 4A, the electrical plug unit A comprises an electrically insulative plug housing 11 having a stepped rear coupling portion 111 and a front opening 112, an electrically insulative locating block 12, which is tightly fitted into the front opening 112 of the electrically insulative plug housing 11 and having two mounting through holes 120, and two metal conducting blades 13 respectively fastened to the two mounting through holes 120 of the electrically insulative locating block 12 for insertion into the neutral slot and hot slot of an electrical outlet (not shown) for power input. Further, a grounding prong 14 may be fixedly mounted in the electrically insulative locating block 12 in a parallel manner relative to the metal conducting blades 13 for insertion into the ground slot of the electrical outlet for grounding.

Referring to FIG. 4B and FIG. 3 again, the lamp socket unit B comprises an electrically insulative socket housing 21 formed of an angled support member 211;212 and a socket member 213, positive and negative copper plates 22, a ring contact 23, a plurality of first spring members 24, a center contact 25, a second spring member 26, a power switch 27, and a third spring member 28. The angled support member 211;212 is formed of a first half shell 211 and a second half shell 212, having a track 214 extending around the periphery of one end thereof. The socket member 213 is coupled to the track 214 of the angled support member 211;212 and rotatable relative to the angled support member 211;212. It is to be understood that the connection arrangement between the socket member 213 and the angled support member 211;212 may be variously embodied, i.e., the socket member 213 can be coupled to the angled support member 211;212 is such a manner that the user can rotate the socket member 213 back and forth through a predetermined angle (or 270-degree angle) relative to the angled support member 211;212. Alternatively, the socket member 213 can be affixed to the angled support member 211;212 and prohibited from rotation relative to the angled support member 211;212. Alternatively, the socket member 213 can be pivotally connected to the angled support member 211;212 and biased relative to the angled support member 211;212 within a predetermined angle.

Figure 5:
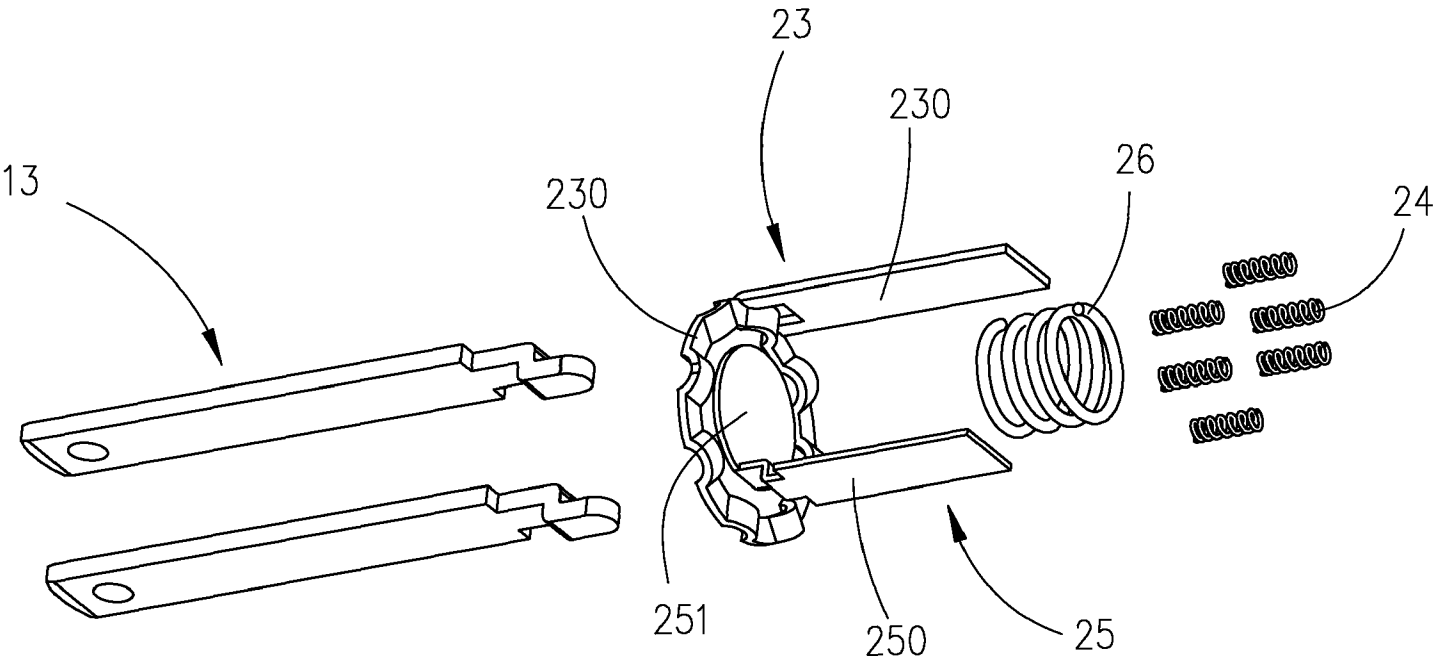
FIG. 5 is an exploded view of a part of the present invention, illustrating the relationship of the metal conduct blades, the ring contact, the center contact, the first spring members and the second spring member.
Figure 6:
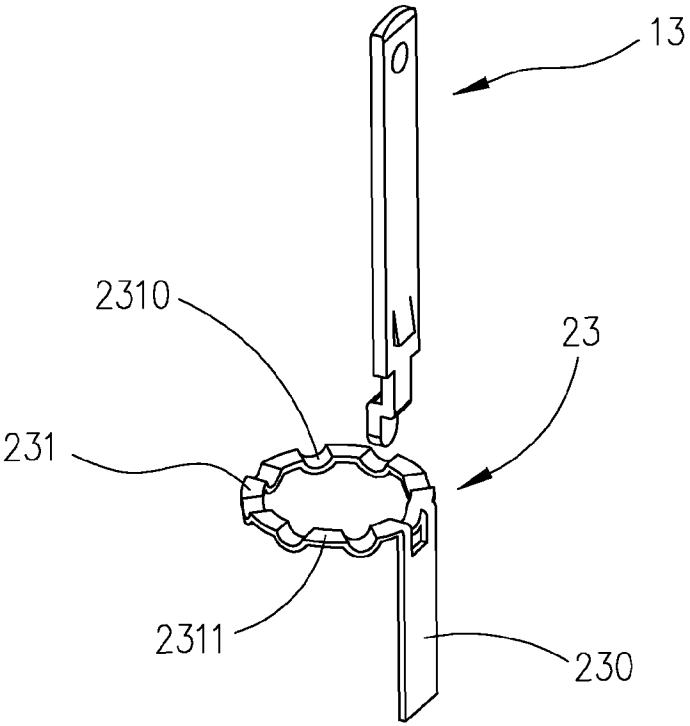
FIG. 6 is an exploded view of a part of the present invention, illustrating the relationship of the ring contact and the associating metal conducting blade.

The positive and negative copper plates 22 are fixedly mounted in the angled support member 211;212 for the contact of the ring contact and tip contact of the lamp bulb (not shown) that is fastened to the socket member 213. Referring also to FIGS. 5 and 6, the ring contact 23 comprises a ring head 231 and a mounting strip 230 perpendicularly extended from the periphery of the ring head 231 and inserted into one transverse groove (not shown) in the first half shell 211. Thus, the ring contact 23 is prohibited from rotation relative to the first half shell 211 but can be moved linearly in direction relative to the axis of the electrical plug unit A. The first spring members 24 are mounted in one end of the first half shell 211 and stopped against the ring head 231 of the ring contact 23 to impart an outward pressure to the ring head 231, forcing the ring head 231 in positive contact with one metal conducting blade 13 of the electrical plug unit A. The ring head 231 comprises a plurality of recessed portions 2310 and raised portions 2311 alternatively and equiangularly arranged on the outer side thereof for the contact of one metal conducting blade 13 of the electrical plug unit A. The center contact 25 comprises a contact head 251 and a mounting strip 250 perpendicularly extended from the periphery of the contact head 251 and inserted into one transverse groove (not shown) in the first half shell 211. Thus, the center contact 25 is prohibited from rotation relative to the first half shell 211 but can be moved linearly in direction relative to the axis of the electrical plug unit A. After installation of the ring contact 23 and the center contact 25 in the first half shell 211, the ring contact 23 and the center contact 25 are respectively kept in contact with the positive and negative copper plates 22, and the ring head 231 of the ring contact 23 is spaced around the contact head 251 of the center contact 25. The second spring member 26 is mounted in the same end of the first half shell 211 and stopped against the contact head 251 of the center contact 25 to impart an outward pressure to the contact head 251, forcing the contact head 251 in positive contact with the other metal conducting blade 13 of the electrical plug unit A. The power switch 27 is mounted on the second half shell 212 and supported on the third spring member 28, and operable to switch on/off the connection between the ring contact 23 and center contact 25 and the positive and negative copper plates 22. Further, the power switch 27 can be a seesaw switch, toggle switch, pushbutton switch, or any of a variety of other switching designs.

Figure 7:
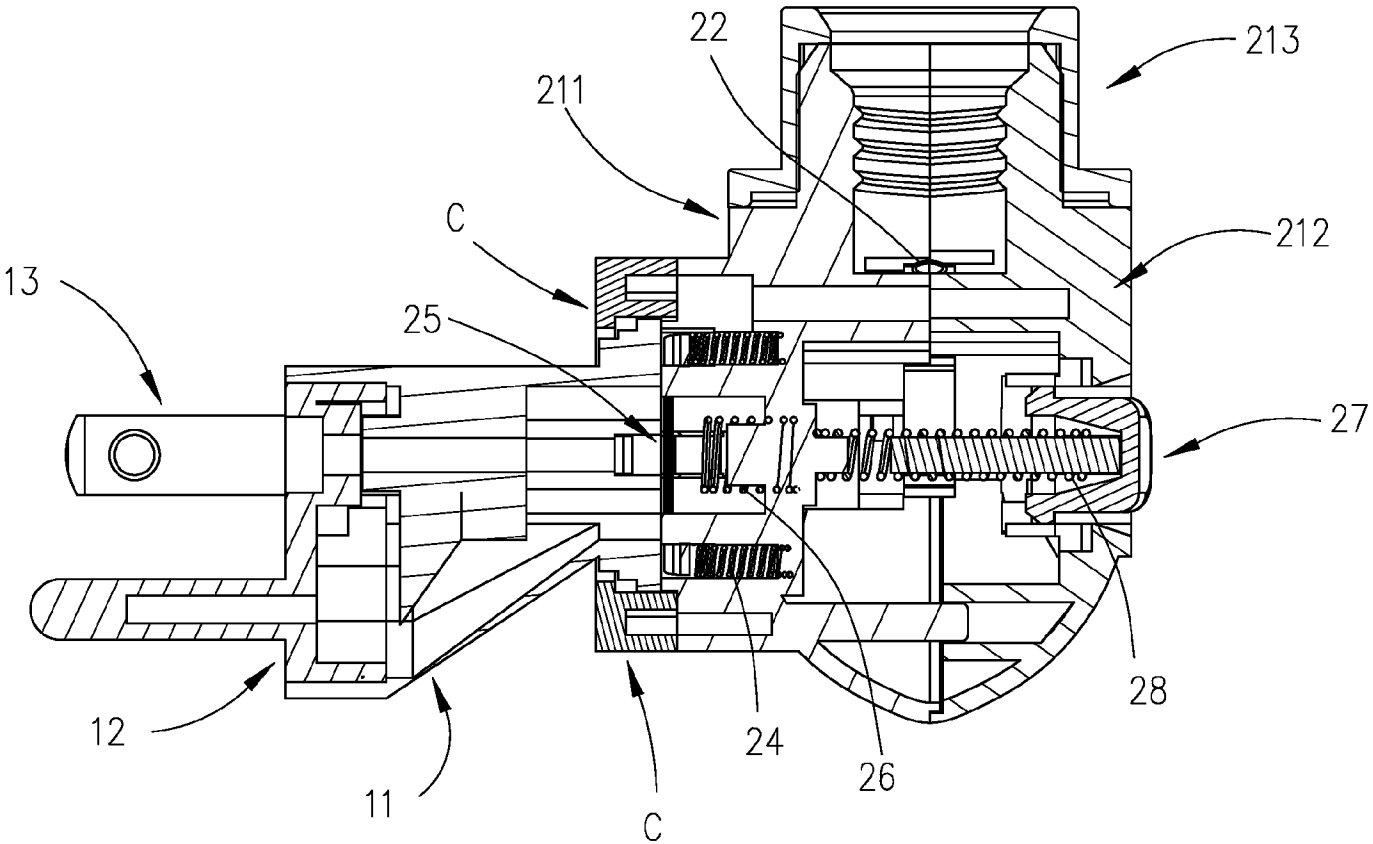
FIG. 7 is a longitudinal sectional view of the angle-adjustable night lamp assembly in accordance with the present invention.
Figure 8:
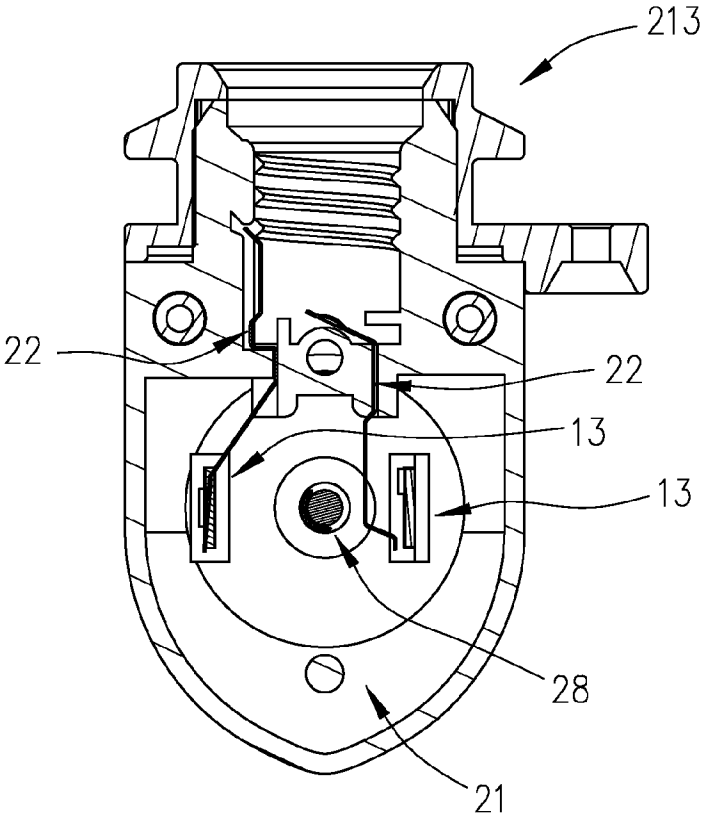
FIG. 8 is a transverse sectional view of the angle-adjustable night lamp assembly in accordance with the present invention.

Referring to FIGS. 7 and 8 and FIGS. 1 and 2 again, the collar C is formed of two symmetrical halves and configured subject to the configuration of the stepped rear coupling portion 111. During installation, the two symmetrical halves of the collar C are attached to the stepped rear coupling portion 111 and abutted against each other, and then fixedly fastened to the first half shell 211 of the angled support member 211; 212 of the electrically insulative socket housing 21 of the lamp socket unit B with fastening members, for examples, screws (not shown) to keep the two metal conducting blades 13 of the electrical plug unit A in contact with the ring head 231 of the ring contact 23 and the contact head 251 of the center contact 25 respectively.

Referring to FIGS. 1-8 again, when rotating the electrical plug unit A relative to the lamp socket unit B and the collar C, one of the two metal conducting blades 13 is constantly kept in contact with the contact head 251 of the center contact 25, and the other of the two metal conducting blades 13 is moved along the recessed portions 2310 and raised portions 2311 of the ring head 231 of the ring contact 23. At this time, the first spring members 24 and the second spring member 26 buffer the pressure and keep the ring contact 23 and the center contact 25 in positive contact with the two metal conducting blades 13 respectively. When the end of the associating metal conducting blade 13 is shifted from one recessed portion 2310 over one adjacent raised portion 2311 to another recessed portion 2310, a clicking sound is produced, giving a indication that the angular position of the lamp socket unit B has been changed relative to the electrical plug unit A through a predetermined angle that is determined subject to the pitch of the recessed portions 2310.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An angle-adjustable night lamp assembly, comprising:

an electrical plug unit adapted for connection to an electrical outlet for power input, said electrical plug unit comprising an electrically insulative plug housing having a stepped rear coupling portion and a front opening, an electrically insulative locating block tightly fitted into said front opening of said electrically insulative plug housing and having two mounting through holes, and a first metal conducting blade and a second metal conducting blade respectively fastened to said two mounting through holes of said electrically insulative locating block for insertion into the neutral slot and hot slot of an electrical outlet for power input;

a lamp socket unit adapted for holding a low-voltage lamp bulb and transferring electric current from said electrical plug unit to said low-voltage lamp bulb for causing said low-voltage lamp bulb to emit light; and a collar configured subject to the configuration of said stepped rear coupling portion of said electrically insulative plug housing of said electrical plug unit and coupled to said stepped rear coupling portion and affixed to said lamp socket unit to secure said lamp socket unit to said electrical plug unit and to allow adjustment of the angle of said lamp socket unit relative to said electrical plug unit.

2. The angle-adjustable night lamp assembly as claimed in claim 1, wherein said electrical plug unit further comprises a grounding prong fixedly mounted in said electrically insulative locating block in a parallel manner relative to said first metal conducting blade and said second metal conducting blade for grounding.

3. The angle-adjustable night lamp assembly as claimed in claim 1, wherein said lamp socket unit comprises:

an electrically insulative socket housing comprising an angled support member fixedly mounted fastened to said collar, and a socket member mounted on said angled support member;

a positive copper plate and a negative copper plate fixedly mounted in said angled support member for the contact of the ring contact and tip contact of a lamp bulb being mounted in said socket member;

a ring contact kept in contact with said first metal conducting blade of said electrical plug unit and electrically connected to one of said positive copper plate and a negative copper plate, said ring contact comprising a ring head and a mounting strip perpendicularly extended from the periphery of said ring head and inserted into one transverse groove in said first half shell such that said ring contact is prohibited from rotation relative to said first half shell and movable linearly in direction relative to the axis of said electrical plug unit;

a plurality of first spring members mounted in one end of said first half shell and stopped against said ring head of said ring contact to impart an outward pressure to said ring head toward said electrical plug unit and to force said ring head in positive contact with said first metal conducting blade of sad electrical plug unit;

a center contact kept in contact with said second metal conducting blade of said electrical plug unit and electrically connected to the other of said positive copper plate and a negative copper plate, said center contact comprising a contact head and a mounting strip perpendicularly extended from the periphery of said contact head and inserted into one transverse groove in said first half shell such that said center contact is prohibited from rotation relative to said first half shell and movable linearly in direction relative to the axis of said electrical plug unit; and a second spring member mounted in one end of said first half shell and stopped against said contact head of said center contact to impart an outward pressure to said contact head toward said electrical plug unit and to force said contact head in positive contact with said second metal conducting blade of sad electrical plug unit.

4. The angle-adjustable night lamp assembly as claimed in claim 3, further comprising a third sprig member mounted in said second half shell of said angled support member, and a power switch mounted on said second half shell of said angled support member and supported on said third spring member and operable to switch on/off the connection between said ring contact and center contact and said positive copper plate and said negative copper plates.

5. The angle-adjustable night lamp assembly as claimed in claim 3, wherein said ring head comprises a plurality of recessed portions and raised portions alternatively and equi-angularly arranged on an outer side thereof for the contact of first metal conducting blade of said electrical plug unit.

6. The angle-adjustable night lamp assembly as claimed in claim 3, wherein said angled support member is formed of a first half shell and a second half shell, having a track extending around the periphery of one end thereof; said socket member is coupled to the track of said angled support member and rotatable relative to said angled support member.

* * * * *